US005690441A

United States Patent [19]

McManus

[11] Patent Number: 5,690,441

[45] Date of Patent: Nov. 25, 1997

[54] EXTENDABLE, RETRACTABLE APPLICATOR BRUSH

[76] Inventor: Jenny L. McManus, 5506 368 Ave., Burlington, Wis. 53105

[21] Appl. No.: 646,830

[22] Filed: May 31, 1996

[51] Int. Cl.[6] ..... A46B 11/00; A45D 34/00

[52] U.S. Cl. ..... 401/127; 401/122

[58] Field of Search ..... 401/127, 122

[56] References Cited

U.S. PATENT DOCUMENTS

| | | | |
|---|---|---|---|
| D. 317,717 | 6/1991 | Carol | D9/341 |
| D. 317,718 | 6/1991 | Carol | D9/341 |
| D. 325,523 | 4/1992 | Nestrepo | D9/377 |
| 68,163 | 8/1867 | Burnet | 401/127 |
| 4,991,988 | 2/1991 | Snell et al. | 401/111 |
| 5,356,232 | 10/1994 | Skinner | 401/52 |

FOREIGN PATENT DOCUMENTS

| | | | |
|---|---|---|---|
| 3000411 | 7/1981 | Germany | 401/127 |
| 4314404 | 11/1992 | Japan | 401/127 |
| 442641 | 1/1968 | Switzerland | 401/127 |

*Primary Examiner*—Steven A. Bratlie

*Attorney, Agent, or Firm*—John Gugliotta; David L. Volk

[57] ABSTRACT

A nail polish bottle includes a threaded upper throat and a cap having internal threads for threadingly engaging the throat of the bottle. The cap supports an elongated applicator brush shaft which terminates in an applicator brush. The applicator brush shaft is slidingly retained within the cap such that the brush shaft can be slidingly extended downward into the nail polish bottle.

3 Claims, 2 Drawing Sheets

EXTENDABLE, RETRACTABLE APPLICATOR BRUSH

RELATED APPLICATION AND DISCLOSURE DOCUMENTS

This application is related to the invention described in the Disclosure Document No. 389,015, dated Dec. 18, 1995.

BACKGROUND OF THE INVENTION

1. Field of the Invention

The present invention relates generally to applicator brushes and, more particularly, to an applicator brush that has an extendable or retractable brush shaft for allowing a user to access fluids at the bottom of a vessel.

2. Description of the Related Art

In the related art, it is generally known that nail polish containers are available having an applicator brush affixed to the inside of the cap by an applicator brush shaft. However, nowhere in the related art is known such a device in which the applicator brush shaft is extendable and retractable relative to the container cap.

In other art however, methods of extending and retracting a shaft are known. For instance, in U.S. Pat. No. 5,356,232, issued in the name of a Skinner, a unified writing instrument and eraser dispenser is disclosed in which a pencil lead is distended to the use of a twist and click actuator affixed to the eraser end of the writing instrument. Similarly, in U.S. Pat. No. 4,991,988, issued in the name of Snell et al., a component writing instrument having a retractable cartridge is disclosed in which a pen having a elongated housing has a writing tip which can be extended and retracted by a press click mechanism of the type generally known and in wide use.

Consequently a need has been felt for providing an apparatus which can be utilized with brush applicators and fluid dispenser bottles such as with nail polish in which the brush applicator can be extended or retracted in order to become long enough in order to reach the bottom of the bottle.

SUMMARY Of THE INVENTION

It is therefore an object of the present invention to provide an improved product dispensing container with applicator brush.

It is a feature of the present invention to provide an improved applicator brush which can be extended or retracted in order to reach fluids near the bottom of the container.

Briefly described according to one embodiment of the present invention, a bottled container with a covering cap is disclosed in which the cap supports an applicator brush which extends down into the fluid vessel. The applicator brush has an applicator brush shaft which is affixed to a push button top and is urged by a tension spring against three internal click stops.

An advantage of the present invention is that it can eliminate the wasting of contained fluids such as nail polish by allowing the vessel to be fully emptied with the applicator brush.

Another advantage of the present invention is that it prevents the user from having to completely screw in the brush on the bottle in order to reach polish in between applications.

Further, the present invention is easy to operate and can be utilized with a variety of contained fluids that require an applicator brush.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which

DESCRIPTION OF THE PREFERRED EMBODIMENTS

1. Detailed Description of the Figures

Figure 1:
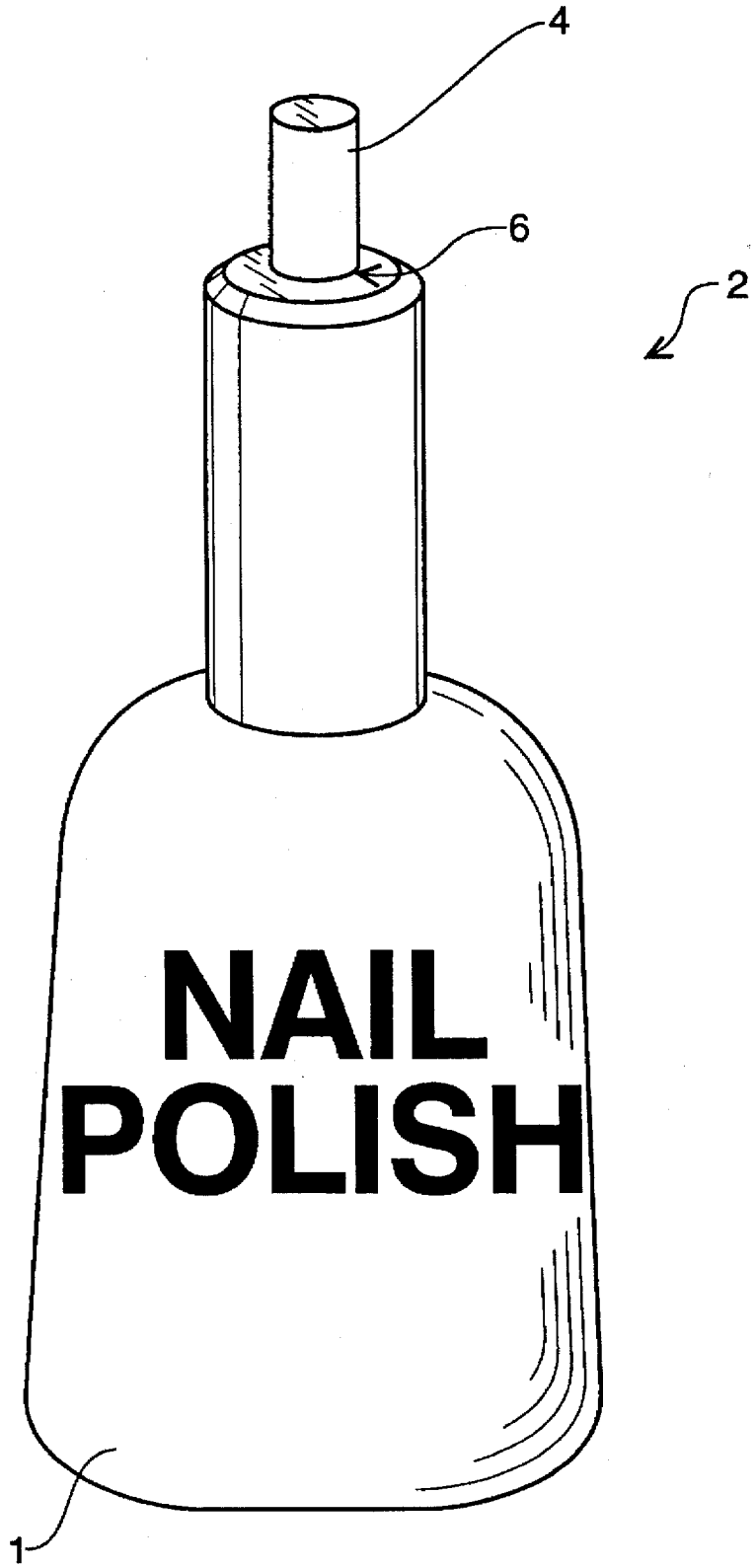
FIG. 1 is a perspective view of a nail polish container in which an adjustable applicator brush cap is utilized according to the preferred embodiment of the present invention.
Figure 2:
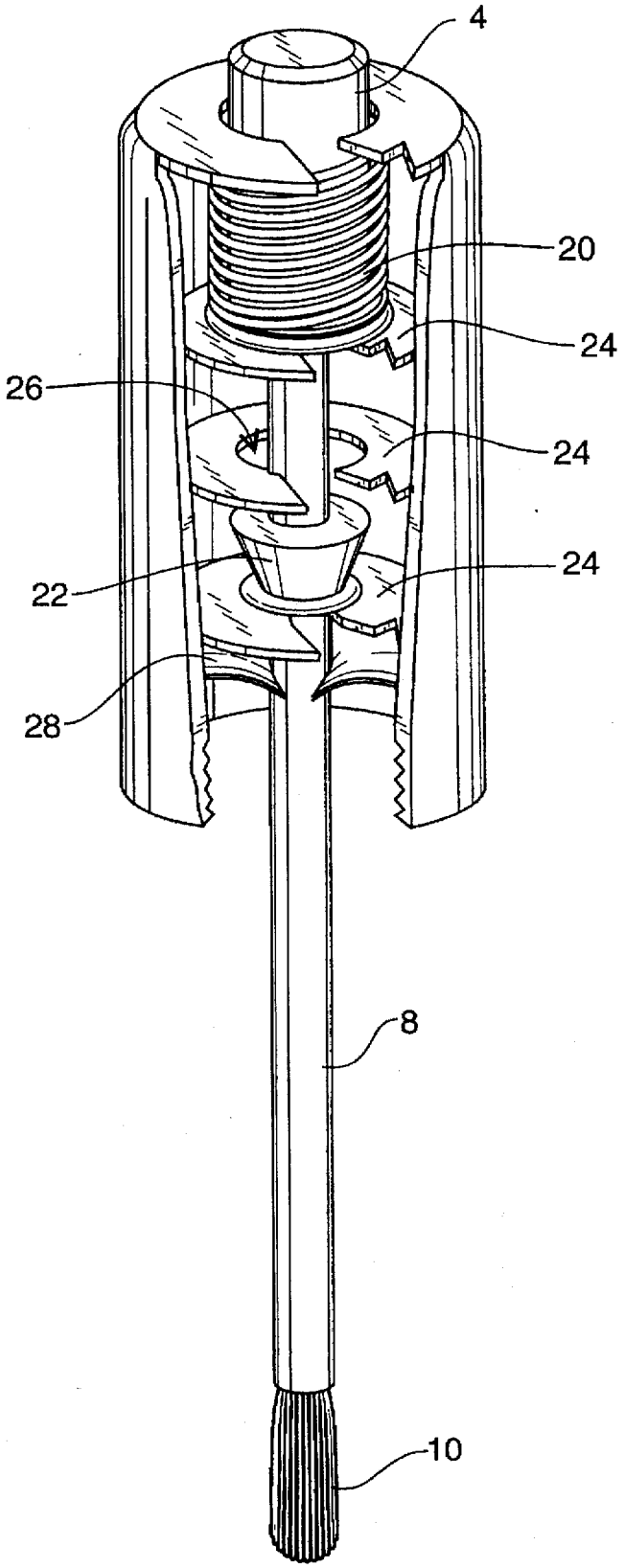
FIG. 2 is a cut away perspective view of a the adjustable applicator brush cap as shown in FIG. 1.

Referring now to FIG. 1, a nail polish container 1 is shown in which an adjustable applicator brush cap 2 according to the preferred embodiment of the present invention is threadingly retained covering the opening of the nail polish bottle 1. The bottle cap 2 has internal threads in an otherwise conventional manner in order to engage with external threads around the throat of the bottle 1. A push button 4 extends, in a discharged manner, from an opening 6 at the top of the cap 2. Fixed to the bottom portion of the push button 4 is an applicator brush shaft 8. The applicator brush shaft 8 is elongated and terminates in an applicator brush 10. In a conventional nail polish bottle with an applicator cap, the applicator brush shaft 8 would be permanently affixed to the brush cap 2. In the improvement of the present invention, the applicator brush shaft 8 is slidingly retained within the brush cap 2 and affixed to the push button 4 such that the brush shaft 8 can be slidingly extended downward into the nail polish bottle 1. In the cap 2 is a tensioning spring 20 for urging the push button top 4 to return to its original position. Affixed circumscribing around the applicator brush shaft 8 at the upper end is a soft plastic or rubber stop 22 fixed in an rigid manner. Affixed within the cap body are a plurality of internal click stops 24 that circumscribe the interior of the cap and form the annular orifice 26 through which the rubber stop 22 passes through in a fitting manner.

It is also envisioned that many methods of extending and retracting rigid shafts, such as those many methods used in pencil and pen arts, can also be adapted for use with the present invention. However, it is felt that due to the fluid nature of the bottle contents, a wipe washer ring 28 is required, providing a sealing barrier to the internal working means of the cap in a fitting manner and about the applicator brush shaft.

2. Operation of the Preferred Embodiment

To use the present invention, simply unscrew the nail polish cap in a typical fashion should the nail polish brush not be long enough to reach the bottom of the bottle then the user must click the top of the brush in a the same manner by depressing the top of a writing pen. Depending upon the depth to reach the user may depress the button on the brush a second or third time thereby continuing to extend the length of the brush. The bottom of the bottle may be easy to reach once the brush is extended after the polishing activity is completed the user should decrease the length of the brush shaft until reaching its original size and return it to the bottle holder.

The foregoing description is included to illustrate the operation of the preferred embodiment and is not meant to limit the scope of the invention. The scope of the invention is to be limited only by the following claims,

What is claimed is:

1. In a nail polish container having a nail polish bottle, a threadingly retained cap, and an elongated applicator brush shaft terminating in an applicator brush and affixed to said cap, the improvement comprising:

said applicator brush shaft being slidingly retained within said cap such that said applicator brush shaft can be slidingly extended downward into the nail polish bottle;

said cap having a top and internal threads for engaging with external threads around a throat of said bottle;

said cap further comprising a push button extending from an opening at the top of said cap, said push button having a bottom portion and wherein said applicator brush shaft is fixed to said bottom portion of said push button;

said cap further comprising a spring affixed between said push button and said cap for urging the push button toward an extended position;

a stop affixed in a rigid manner, circumscribing the applicator brush shaft between the applicator brush and the spring;

a plurality of internal click stops affixed within said cap that circumscribe the interior of the cap and form an annular orifice through which said stop passes.

2. In the nail polish container as described in claim 1, wherein said cap further comprises:

a wipe washer ring for providing a sealing barrier to the internal working means of the cap in a fitting manner and about said applicator brush shaft.

3. A nail polish container comprising:

a nail polish bottle for holding an internal volume of fluid and having a threaded upper throat;

a cap having internal threads for threadingly engaging said throat of said bottle;

an elongated applicator brash shaft terminating in an applicator brush;

a push button extending from an opening at a top of said cap, said push button having a bottom portion and wherein said applicator brush shaft is fixed to said bottom portion of said push button;

a tensioning spring affixed between said push button and said cap for urging the push button forward an extended position;

a stop affixed in a rigid manner, circumscribing the applicator brush shaft between the applicator brush and the spring;

a plurality of internal click stops affixed within said cap that circumscribe the interior of the cap and form an annular orifice through which said stop passes; and a wipe washer ring positioned and configured to provide a sealing barrier to the internal working means of the cap;

said applicator brush shaft being slidingly retained within said cap such that said brush shaft can be slidingly extended downward into the nail polish bottle.

* * * * *